US012365532B2

(12) United States Patent
Prieto

(10) Patent No.: US 12,365,532 B2
(45) Date of Patent: Jul. 22, 2025

(54) INFLATABLE STORAGE CONTAINER

(71) Applicant: DEPLOY TECH LTD, London (GB)

(72) Inventor: Paul Vinicio Mendieta Prieto, London (GB)

(73) Assignee: DEPLOY TECH LTD, London (GB)

( * ) Notice: Subject to any disclaimer, the term of this patent is extended or adjusted under 35 U.S.C. 154(b) by 137 days.

(21) Appl. No.: 18/005,737

(22) PCT Filed: Jul. 14, 2021

(86) PCT No.: PCT/GB2021/051816
§ 371 (c)(1),
(2) Date: Jan. 17, 2023

(87) PCT Pub. No.: WO2022/013557
PCT Pub. Date: Jan. 20, 2022

(65) Prior Publication Data

US 2023/0286735 A1 Sep. 14, 2023

(30) Foreign Application Priority Data

Jul. 14, 2020 (GB) ..... 2010799

(51) Int. Cl.
*B65D 90/02* (2019.01)
*B65D 90/04* (2006.01)
*B65D 90/54* (2006.01)

(52) U.S. Cl.
CPC ..... *B65D 90/022* (2013.01); *B65D 90/04* (2013.01); *B65D 90/54* (2013.01)

(58) Field of Classification Search
CPC ..... B65D 90/022; B65D 90/04; B65D 90/54; B65D 27/00–37/00; E04H 7/24
See application file for complete search history.

(56) References Cited

U.S. PATENT DOCUMENTS 2,715,085 A * 8/1955 Boger ..... B64D 37/06 220/900
2,973,293 A * 2/1961 Schofield ..... B64D 37/02 428/476.3

(Continued)

FOREIGN PATENT DOCUMENTS

EP 0465354 A1 1/1992
EP 2027319 B1 12/2016

(Continued)

OTHER PUBLICATIONS

UK Intellectual Property Search Report issued in related Application Serial No. GB2010799.1 on Sep. 8, 2020.

(Continued)

*Primary Examiner* — Kareen K Thomas
(74) *Attorney, Agent, or Firm* — Brian J. Colandreo; Jeffrey T. Placker; Holland & Knight LLP

(57) ABSTRACT

An inflatable storage container (100) for liquids or other bulk materials comprises a first portion (5) that defines abase and a second portion (4) that defines a perimeter wall that extends from a perimeter of the base, the two portions together forming an inflatable chamber. The perimeter wall comprises at least one layer of cloth that has been impregnated with a water-settable material. In use, after or when the inflatable chamber is inflated and the water-settable material is set, the first portion and second portion define a storage chamber for a liquid or other bulk material. A method of deploying a deployable storage container is also provided. A combination of a container and an inflation system suitable for inflating the container to form its final deployed shape prior to the water-settable material having set is further provided.

17 Claims, 7 Drawing Sheets

(56) References Cited

U.S. PATENT DOCUMENTS 4,172,573 A * 10/1979 Moore ..... B64D 37/08 220/900
4,573,508 A * 3/1986 Knaus ..... B65D 88/1656 220/666
5,188,266 A * 2/1993 Loulias ..... A45F 3/16 383/110
5,499,743 A * 3/1996 Blumenkron ..... B65D 88/1656 383/110
5,524,781 A * 6/1996 Podd ..... B65D 90/046 383/103
5,589,241 A * 12/1996 Stiles ..... B29C 49/24 428/35.8
6,047,848 A * 4/2000 Davis ..... B65D 1/0292 220/666
6,860,218 B2 * 3/2005 Eagles ..... B65D 88/16 114/256
7,717,296 B1 5/2010 Guthrie
8,317,059 B2 * 11/2012 Kisiler ..... B60K 15/03177 220/4.12
9,297,133 B2 * 3/2016 Mills ..... B67D 7/00
2012/0279959 A1 * 11/2012 Clive-Smith ..... B65D 88/02 220/9.4
2019/0024361 A1 * 1/2019 Keville ..... E04B 1/19
2020/0338472 A1 * 10/2020 Fukai ..... C02F 1/42

FOREIGN PATENT DOCUMENTS

EP 2393970 B1 11/2017
WO 2005017291 A1 2/2005
WO 2005124063 A2 12/2005
WO 2017207817 A1 12/2017
WO 2022/013557 A1 1/2022

OTHER PUBLICATIONS

International Search Report and Written Opinion issued in International Application Serial No. PCT/GB2021/051816 on Oct. 18, 2021.

* cited by examiner

INFLATABLE STORAGE CONTAINER

CROSS-REFERENCE TO RELATED APPLICATIONS

This application is a U.S. National Stage of International Patent Application No. PCT/GB2021/051816, filed 14 Jul. 2021, which claims priority to Great Britain Patent Application No: 2010799.1, filed on 14 Jul. 2020, the disclosures of which are incorporated herein by reference in their entirety.

This invention relates to storage container for liquids and other bulk materials and in particular to a deployable large container for the storage of potable water in remote areas. It also relates to a method of erecting such a container.

TECHNICAL BACKGROUND

It is a sad truth that in many of the less developed areas of the world there is only limited access to potable water. People without access to clean and safe water run the risk of contracting many diseases. Similar risks are present in areas where the normal sources of water have been contaminated such as in the aftermath of a natural or man-made disaster.

A need therefore exists to provide for large storage containers which can be easily taken to a site, often across difficult terrain, in a compact form, and then deployed into its final shape with the minimum of tools and skills required. The container must be stable as a large volume of potable water is extremely heavy and durable.

Conventional large storage containers are bulky as they are manufactured as rigid units. This makes them unsuited for shipping to hard reach areas. An alternative is the onsite fabrication of metal or concrete storage containers but this requires a lot of equipment and skilled labour. A concrete structure would conventionally require a large formwork to be constructed which is a skilled task and requires a lot of material such as timber that may not be at hand. Fabricating from steel is a specialist and dangerous task.

EP0465354 discloses an emergency shelter that has a flexible sheet, the periphery of which is weighted down, e.g. by a water-filled chambers. The shelter is formed by blowing air under the flexible sheet, which causes the centre of sheet to rise and form a space underneath it that can accommodate people. Air must be blown continuously under the sheet to maintain this inflated state.

U.S. Pat. No. 7,717,296 discloses a water tank having walls formed of fabric impregnated with PTFE to make it waterproof. The tank may be filled with water and transported on a vehicle to its destination, where the water is discharged and then the tank is collapsed for storage.

WO2005/124063 discloses an emergency shelter that includes a fabric that has been impregnated with cement. Like EP0465354, air can be blown under the fabric to form a dome. Water is then sprayed over the fabric, causing the cement to set. Once set, the dome is self-supporting and air pressure underneath can be released to provide a space underneath the dome suitable for accommodating people.

WO2010/086618 and WO2007/144559 (also published as EP2393970 and EP2027319) both disclose cement-impregnated fabrics that can be set by spraying the fabric with water. These fabrics can be used to form shelters as disclosed in WO2005/124063 or by draping the fabric over a framework and spraying the fabric with water. It can also be used to reinforce river banks, to repair pipes and to form pipes. It also discloses the use of the fabric to form a waterproof lining for the containment of water, e.g. a pond, canal lining, water storage or sceptic tanks. However, all these water-containment applications rely on the use of a support, which is generally the ground, i.e. the water containment is in a hollow in the ground and there is no disclosure of a water containment application where the walls of a water container are self-supporting.

BRIEF SUMMARY OF THE INVENTION

According to a first aspect the invention provides an inflatable storage container for liquids or other bulk materials with the features recited in claim 1. Optional and/or preferable features are set out in the dependent claims.

The applicant has appreciated that an inflatable container capable of holding liquid would be especially suitable for solving the problems of storage of liquids in hard-to-reach places and in emergencies.

Specifically, the container may comprise:

a first portion that defines a base, a second portion that defines a perimeter wall and extends from a perimeter of the base, and the two portions defining an inflatable chamber, characterised in that:

the perimeter wall comprises at least one layer of cloth that has been impregnated with a water-settable material, whereby in use the inflatable chamber defines a storage chamber for liquids or other bulk materials.

By in use we mean the arrangement of the inflatable chamber after or when inflating and setting of the water-settable material.

The container may be configured so that once the water-settable material has set, a self-supporting container or tank is formed. The container may be installed above ground. The container may provide sufficient stability for the storage of a liquid such as potable water. The walls may be self-supporting. The walls may prevent the container from collapsing once they have set rigidly.

The perimeter wall and base shall be continuous apart from any required inlet and outlets for ingress and egress of liquid and, where chosen, a separate sealable inlet for use when inflating the container. The deployed container therefore defines a suitable volume for containing liquid.

The container may comprise a third portion defining a lid that closes an upper edge or top of the perimeter wall to seal the container during inflation. In this case all three portions each may define a part of the skin of an inflatable chamber.

The lid may be removable once the container has set rigid after inflation and hydration of the water-settable material, or may form a permanent part of the finished container. Where removable, it may have only a temporary utility in sealing the air tight chamber and may be absent in the final erected container.

The third portion may include an access hatch for access to the interior once inflated, which may be sufficiently large for a worker to enter the container. For instance, it may have be a circular hatch with a diameter of at least 450 mm.

The second portion may define substantially vertical walls once the container has been inflated, that may be located entirely above ground or at least partially buried.

The first, second and third portions may together define a single interior chamber for receiving air for inflation and for storing liquid once deployed. This may define a volume that is approximately equal to the volume of the exterior of the container, maximising the storage volume through the use of relatively thin walls and base.

The perimeter wall and base may be constructed at least in part from common pieces of material, for instance with some of the material forming part of the base and also part of the walls. Alternatively, they may be separate but integrally formed pieces of material.

The perimeter wall most preferably is connected along a lower edge to an outermost perimeter of the base. Fastening portions may extend from the base that allows it to be pegged out into position.

The container may further include means for transferring liquid into and out of the container. For example, this may comprise a fluid inlet and a fluid outlet that connects an interior of the container to the exterior. Each inlet may be releasably opened and closed, for instance using a valve or cap.

The invention therefore provides a solution to the rapid and simple construction of large volume containers in areas of most need, such as in areas that have been contaminated.

The second portion may further include an inner layer of water impermeable material that isolates the cloth from the interior of the inflatable chamber.

The inner layer may comprise a geotextile material. In one convenient arrangement the inner layer may comprise a food grade material such as flexible polyvinyl-chloride sheet. An example that may be used is the material sold under the brand name Alkorplan 35053 by Renolit Iberica S.A which is suitable for use with potable water.

The base may also include an inner layer of the same material. The base and walls together form a water tight chamber once inflated.

The base and the cover and optionally the lid may each also comprise at least one layer of cloth that has been impregnated with a water settable material.

The base and cover may each also comprise an inner layer of water impermeable material.

The applicant has appreciated that a water-settable material including cement based material works well under compression, but in the case of a container for liquid the container will in use be acting under considerable tension.

After the water-settable material has set, the storage container may be self-supporting when installed above ground, i.e. the walls will themselves be self-supporting.

The container may further comprise a reinforcement structure that acts under tension when the container is filled with liquid.

The reinforcement structure may comprise one or more cables.

The cables may comprise elongate wound fibres of synthetic material which extend continuously around the perimeter wall.

The cables may comprise stainless steel cable.

As an alternative to cables, the reinforcement may comprise panels of additional material that are fixed to the perimeter wall. These panels may be located in regions of high expected stress.

The reinforcement structure may be flexible allowing it to be folded into various shapes when the container has yet to be deployed.

The reinforcement structure may be located entirely within the inside of the inflatable chamber.

It may be fixed to the inner layer of at least one of the first portion, second portion and third portion.

Alternatively the reinforcement structure may be embedded within one or more of those portions. For instance, it may be embedded between two layers of a portion.

In a further alternative, the reinforcement structure may be located outside of the inflatable chamber. It may be located partially inside and partially outside for example.

The perimeter wall of the inflated container may be circular when viewed in plan.

The reinforcement structure may define one or more substantially horizontal circular hoops that extend around the wall.

Preferably there are two, or three, or more hoops each spaced apart vertically when the container is inflated.

The reinforcement structure may comprise inelastic material so that when placed under tension the structure does not stretch and hence prevents bursting of the perimeter wall.

The container may also comprise a support structure comprising a plurality of elongate substantially rigid rods that are oriented substantially vertically to help support the inflated structure against vertical loads. The support structure may be shaped to support the lid portion so that it will not pool with water. Of course, whilst the support structure will give added support to the container, the walls will themselves be self-supporting and provide the main feature for preventing the collapse of the container once they have set rigidly.

The rods may be bendable without the use of tools to conform to the inner shape of the container and may comprise fibre glass poles. Such poles are relatively inexpensive and light.

One or more of the rods may extend up from the base, along the inside of perimeter wall, across the top, and back down the inside of an opposing section of the perimeter wall to form an inverted u-shape or rotated c-shape.

The supporting structure may elevate a centre most region of the top above the level of the perimeter wall to prevent ponding of rainwater on the top of the deployed container.

The reinforcement structure and the support structure may be located inside the inflatable space.

In a preferred arrangement the hoops are threaded through loops of material secured to the inner layer of the perimeter wall. These loops may be thermally bonded to the inner layer, and may comprise the same material as the inner layer although different material may be used.

The water-settable material may comprise a water-settable mixture sandwiched between at least two layers of cloth. At least one layer of the cloth may be a felt material.

The water settable material may be cement based, most preferably quick setting cement. This may be mixed with aggregate such as stone and sand is as known to the person skilled in the structure of a concrete mix. Reinforcing fibres may also be added to the mix. The perimeter wall may comprise one layer, or multiple layers, of material.

A particularly suitable material is that developed by Concrete Canvas Ltd, Cowbridge Road, Talbot Green, Pontyclun, CF72 8HL, UK that is called Geosynthetic-Cementitious-Composite Mats (GCCMs). Various arrangements of such a material are disclosed in their European patents No. EP2393970B1 and EP 2027319B1 the teachings of which are incorporated by reference.

Portions of the deployable storage container may in a pre-deployment state be folded to fit within a footprint that is no larger in area than the base, and preferably a smaller area than that. This is especially beneficial where the container has a large capacity, for instance 10,000 litres or more, and would if preformed be too bulky to transport efficiently.

The folding of the portions may be implemented in a manner that enables a smooth inflation of the container as air is introduced into the air tight chamber.

Most preferably the folded container, prior to the settable material having been set, may have a footprint that fits within the outline of a standard 1 meter by 1 meter shipping pallet or another size such as a standard 2 meter by 1 meter shipping pallet.

In a deployed condition the container will be self-supporting, and should be designed so that it has sufficient strength to withstand being completely filled with a liquid such as potable water.

The inlet and outlet may be separate or may be combined as a single port fitted to the container. They are preferably fitted into a lower region of the perimeter wall of the deployed container.

The container may include an air inlet valve which enables the inflatable chamber to be inflated using air or any other suitable gas. Inflation by filling with liquid may be possible but the use of a gas is much preferred as the material will not be stable prior to setting and a large container full of liquid could place considered stress on the material and make it difficult to achieve the desired inflated shape.

In an alternative the inlet or outlet valve may be adapted to also permit the inlet of gas for inflating the chamber.

The deployable container of the invention is very well suited to the storage of bulk materials in the form of liquids, and in particular potable drinking water. Because it is inflatable it may be easily deployed in less developed areas or disaster zones as it can be easily transported and easily assembled with few tools.

For a large sized container, for instance able to hold 40000 litres or more of liquid, the base may comprise two or more panels of material that are welded together during manufacture. Of course the base could be made in a single unified sheet if the material is available.

A container in accordance with the invention would be suited to a wide range of additional applications beyond the storage of potable water including but not limited to:

- Non-potable Water Storage
- Septic Tanks
- Water treatment units including:
  - Flocculation basin
  - Sedimentation basin
  - Filter unit
  - Aeration unit
  - Digester unit
  - Clarifier unit
- Wine and beer storage; and
- Pools The container may also be used for non-liquid storage such as soil, grains and more.

In an embodiment the inflatable storage container comprises a gas inlet valve which enables the inflatable chamber to be inflated using air or any other suitable gas.

According to a second aspect the invention provides a method of deploying a deployable storage container according to the first aspect comprising:

- transporting the container to an installation site when in a folded state,
- partially unfolding as required to lay out the base of the container on the ground or other surface,
- inflating the inflatable chamber e.g. with pressurised air,
- adding water to the water-settable material, and
- after the water-settable material has set releasing the air pressure.

The method may optionally including adding further reinforcement structure to the container before or after the settable material has set.

The method may comprise accessing the interior of the container through an access hatch at the top of the container to position the poles.

In a still further aspect the invention provides in combination a container according to the first aspect and an inflation system suitable for inflating the container to form its final deployed shape prior to the water-settable material having set.

There will now be described, by way of example only, to embodiments of a deployable storage container for liquids with reference to the accompanying drawings of which:

DETAILED DESCRIPTION OF AN EMBODIMENT

Figure 2:
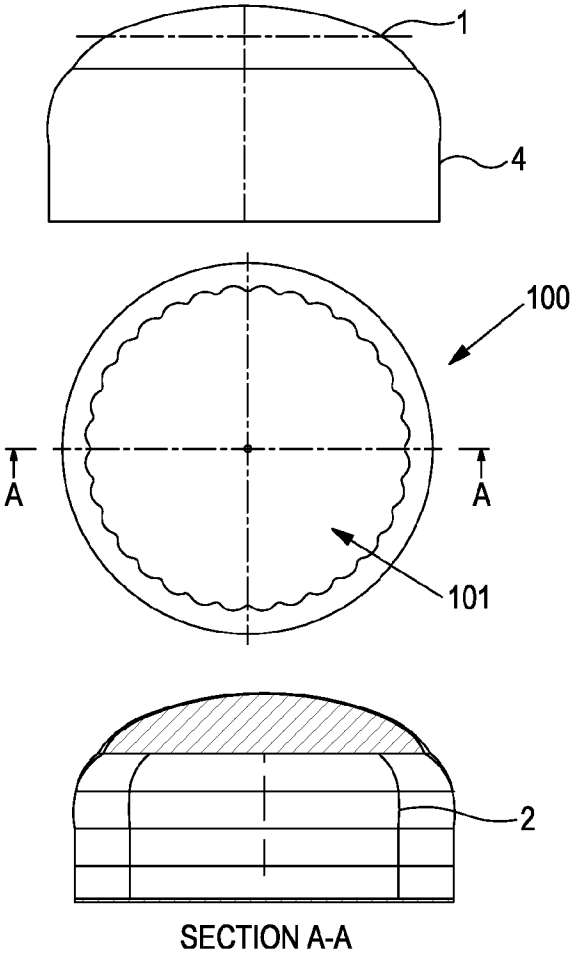
FIG. 2 is a third angle projection of the container of FIG. 1
Figure 1:
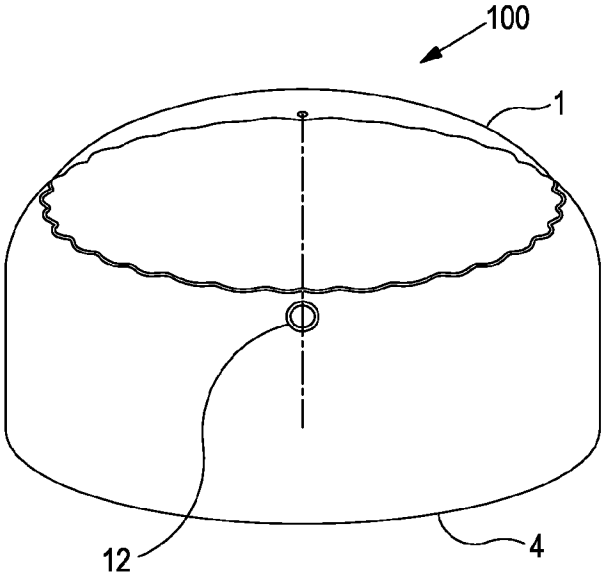
FIG. 1 is an isometric view of a deployed container which falls within the scope of the first aspect of the present invention.
Figure 3:
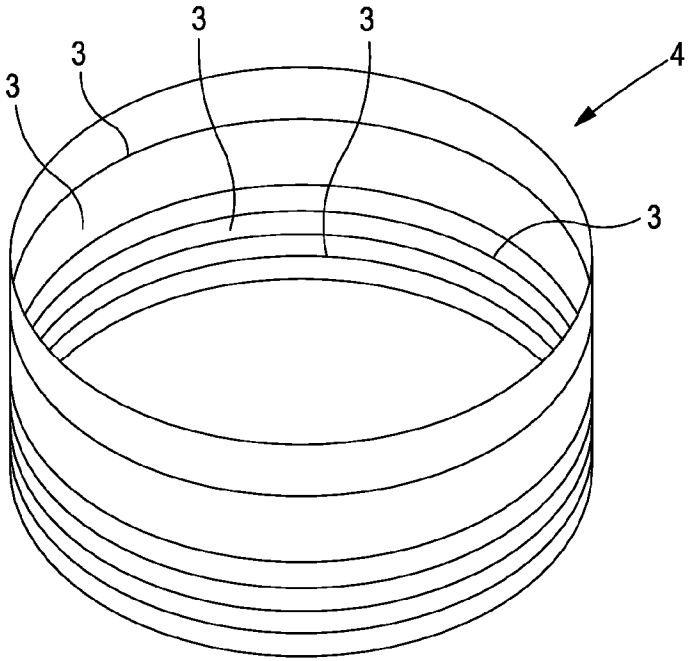
FIG. 3 is a view of perimeter wall only showing five reinforcing hoops of stainless steel cable fixed to the inner wall.
Figure 4:
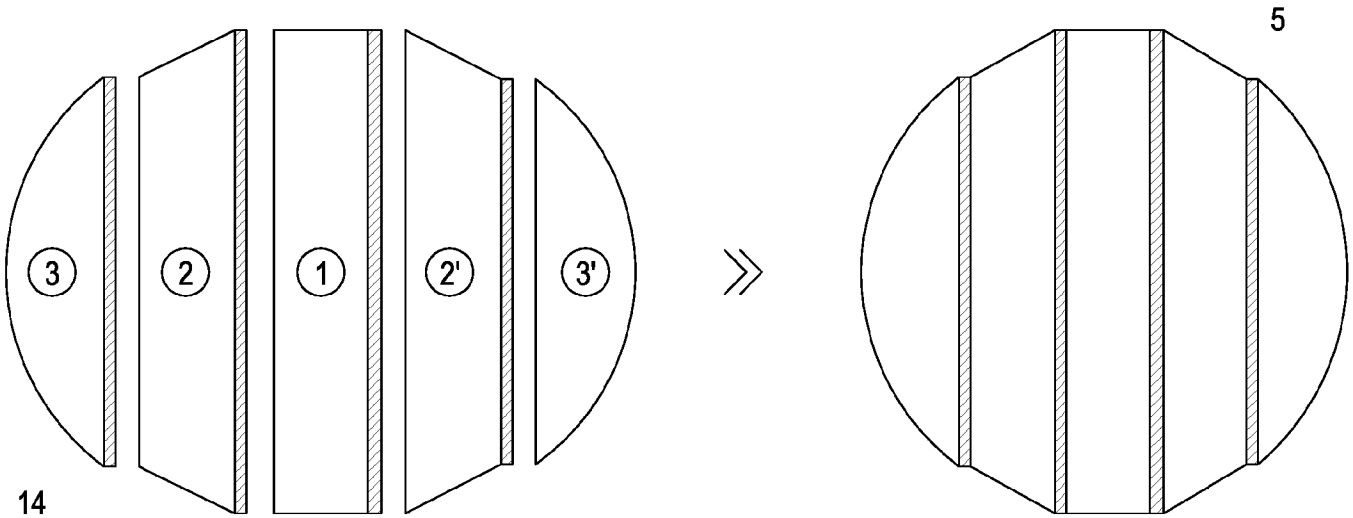
FIG. 4 is an illustration of the construction of the base from multiple panels that are welded together.

As shown in FIGS. 1 to 4 and FIG. 7 of the drawings a deployable container 100, or tank, comprises a base portion 5, a perimeter wall 4, and top portion forming a lid 1, and a reinforcement structure 3. All these components, prior to deployment, are relatively flexible enabling them to be folded up into a compact package. Once deployed, as will be explained, they form a rigid and self-supporting container structure.

The perimeter wall 4 is joined along a lower edge to the circular base 5 to form a cylinder that is substantially vertical. The lid 1 covers the top of the cylinder and is joined along an outer circumference to a top edge of the perimeter wall.

The base 5 determines the shape the product will follow at the moment of inflation. For manufacturing and technical reasons a circular shape is preferred but not essential.

The perimeter wall 4, and in this example also the base portion 5, each comprise at least one layer of cloth that has been impregnated with a water-settable material. This material will be flexible prior to deployment allowing the container to be folded up into a compact package.

The three portions together form an airtight chamber 101 that can be inflated, and this is used as the method of deployment of the folded container 100. When under pressure the chamber will expand to open up the perimeter walls and raise the lid. In this state, the water-settable material can be soaked in water and left to set. Once set, the pressure in the chamber can be released and the container will be self-supporting.

Figure 8:
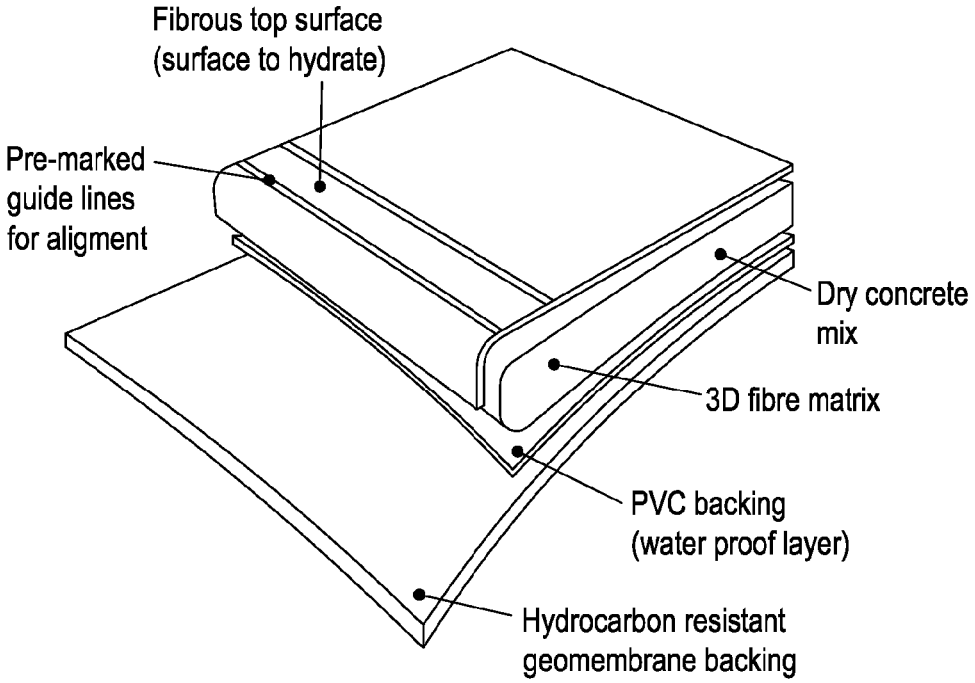
FIG. 8 is an isometric cutaway view of the material that is used in the example to form the perimeter wall 8.

The perimeter wall comprises an inner layer. In this example, the perimeter wall comprises a single layer of CC Hydro™ that is both air tight and water tight. This is bonded to the outer layer of the wall. This is shown in detail in FIG. 8 of the drawings.

The wall 4 of the tank will contain the liquid, such as potable water, inside the chamber 101 and also needs to withstand the pressure generated by the water. To resist pressure in the chamber once full of potable water from bursting the walls, a set of five stainless steel hoops 3 are provided that form a reinforcement structure. More, or fewer, may of course be used depending on the size of the container and materials used and so on. These are offset vertically along the wall and extend continuously around the inner layer. They are bonded in place by threading through loops thermally bonded to the inner layer of the perimeter wall. These hoops, being of an inelastic material, can prevent the walls being expanded and will hence stop the container from bursting. They can best be seen in FIG. 3 of the drawings.

Also, the reinforcement structure helps constrain the expansion of the material during inflation to obtain a specific shape and form. Another way to improve the tension resistance of the wall is adding more layers of geomembrane to increase the thickness of the wall, therefore, adding rigidity.

A suitable material that may be used for the walls may be as described in EP2393970 and also in EP (2027319) and can be purchased from Concrete Canvas limited under the brand name Hydro.

Due to the thickness of the wall 4 (CCH5=5 to 6 mm) and the height of the wall (h=2 m for a convenient 4000 litre tank form) the material can suffer from bulking. The weight of the lid and wind can make the walls collapse. Therefore, the container has an additional support structure in the form of added fiberglass poles 2 to provide vertical reinforcement. In this example as shown in FIG. 7 there are four poles that are installed, that go from one side to the other inside the tank forming an inverted U-shape.

The support structure is able to help maintain the form of the container but is not sufficiently strong as to take the full weight of the container walls and lid. This strength is provided by the perimeter wall under a generally compressive (vertical) loading.

Figure 7:
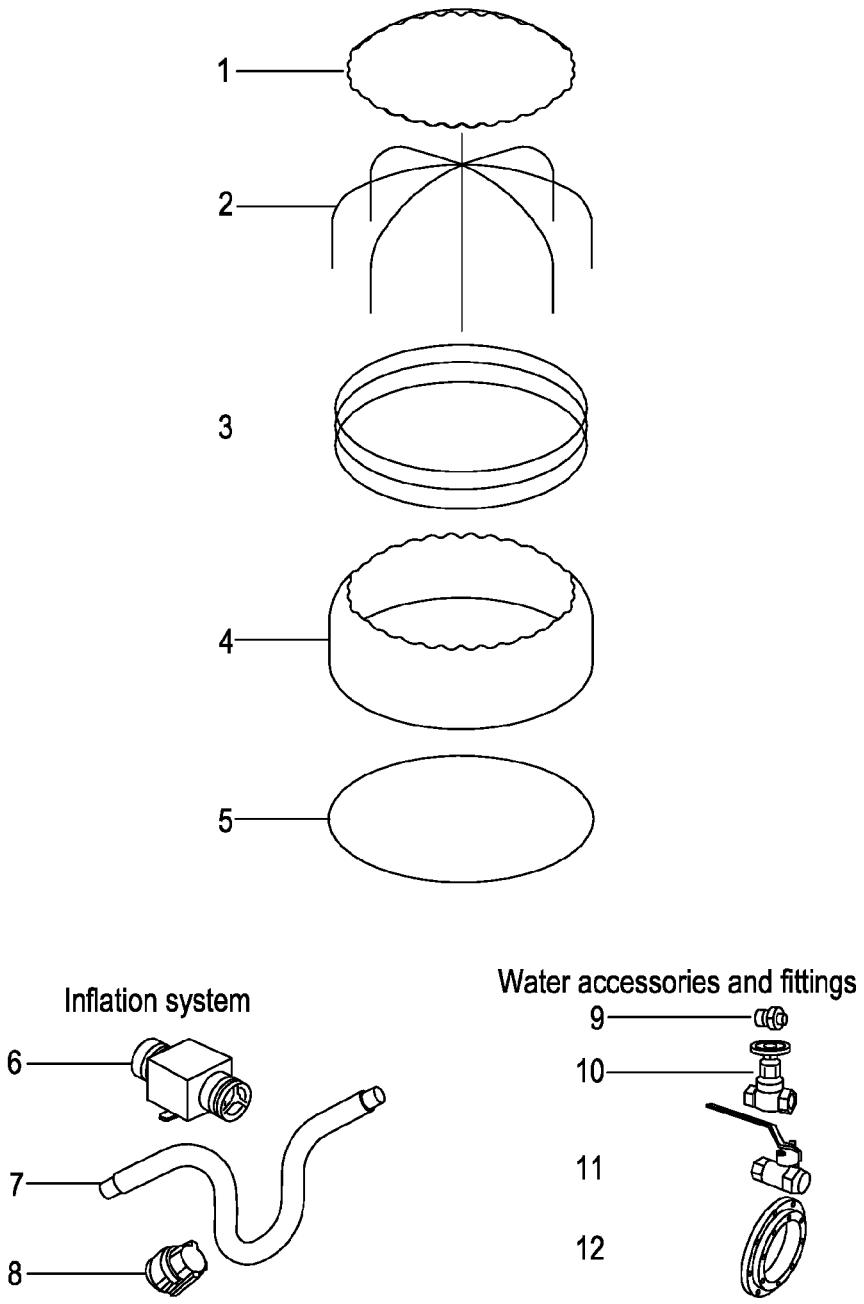
FIG. 7 is an exploded view of the full component set required to deploy the container including the parts used to make the container itself.

To accommodate the functionality of the tank the perimeter wall 4 incorporates a set of standard tank accessories and fittings 9, 10, 11 and 12 in FIG. 7. The diameter of the tank and the accessories depends on the necessities of the end user.

As well as the standard tank fittings, a further inlet 12 is located towards the top of the wall or in the lid portion. This has two functionalities. During the inflation system it helps connecting the inflation system with the interior of the container. Then, when the container is under use it has an overflow functionality to avoid the container from over loading with water.

Figure 5:
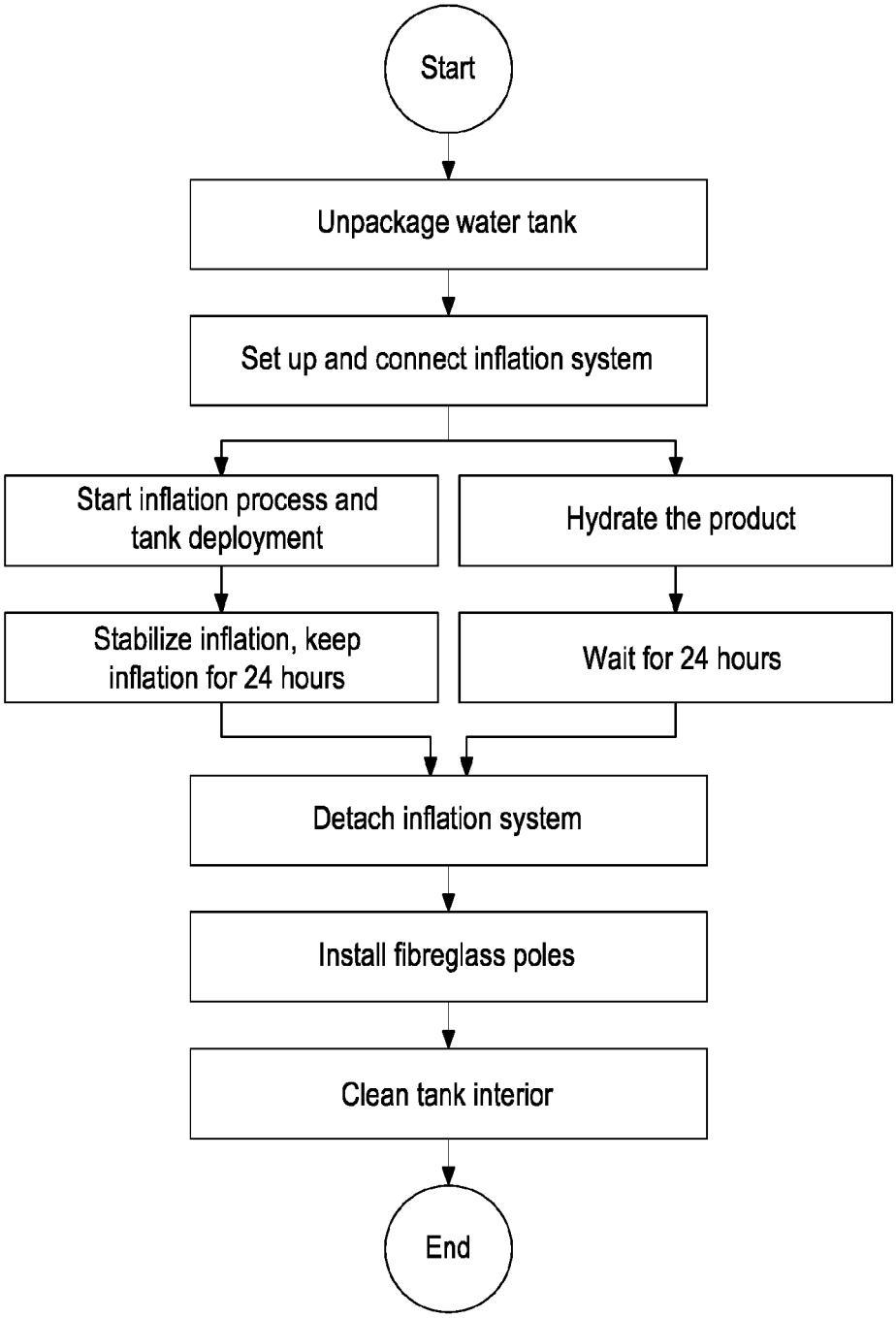
FIG. 5 is a flow diagram showing the steps of deployment of the container.

FIG. 5 shows in detail the steps carried out during a deployment of the container.

In a first step the package is unpacked at or close to its final installation position. An inflation system, such as the pump 6, hose 7 and nozzle 8 shown in FIG. 7, are then connected to the air chamber inside the package and the inflation process is started. At the same time, or later, the material for the side wall and top are hydrated. This may be as simple as spraying them with rainwater. Once at the required pressure to push out the container to its final shape, it is stabilised and left for 24 hours for the walls to become rigid.

The air pressure can then be released by detaching the inflation system and the internal fibre glass poles installed by entering through an access hatch in the lid (not shown), the interior can then be cleaned and is ready for use.

The inflation components have the only purpose to deploy the tank to reach the shape and form needed, as well as, stabilizing the structure whilst the 24-hour hardening process is happening.

Figure 6:
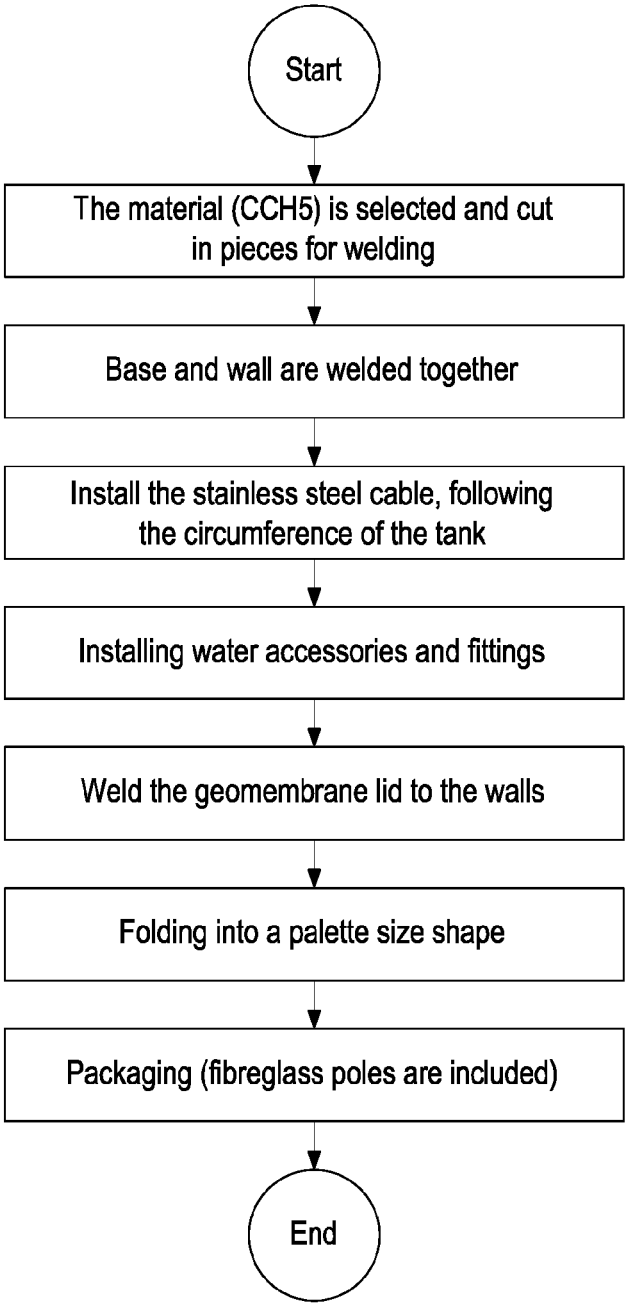
FIG. 6 is flowchart of the steps that may be used to manufacture the container.

The flowchart of FIG. 6 shows one method that may be used to manufacture the container 100. Having selected a suitable material, pieces are cut to shape and the base and walls are welded together. The stainless steel cables that form the reinforcement structure are installed following the circumference of the wall and the water accessories, items 9 to 12 in FIG. 7, 10 are fitted to the side wall. The inlet valve of the inflation system is also installed close to the top of the side wall. The top portion is then fitted to form a lid and the container may be checked for air-tightness. Lastly the whole assembly is folded into a palatable sized shape and packaged with the support poles ready for use and the inflation system.

The skilled reader will appreciate that the container of the invention can be used to provide a community-led approach to water management in rural communities by providing an innovative air-deployed, ready-to-use concrete water tank manufactured with a filled concrete fabric that requires little skill to deploy and has a small packed volume prior to deployment. When hydrated the container transforms into a unified concrete shell body that ensures the durability, resistance, and reliability of the product. When folded and packed, it can be transported in a standard pallet, and when the user executes the simple deployment procedure, it can reach a volume of up to 40 000 litres or more, creating a permanent concrete tank that will be ready to use in just 24 hours. Its modularity and transportability help users to strategize the usage and location of their water-related infrastructure to maximize efficiency and convenience for almost any application (storage, distribution, and even sewer water) without any technical help or construction contractors.

The invention claimed is:

1. An inflatable storage container for liquids or other bulk materials comprising:

a first portion that defines a base, and a second portion that defines a perimeter wall that extends from a perimeter of the base, the two portions together forming an inflatable chamber, characterised in that:

the perimeter wall comprises at least one layer of cloth that has been impregnated with a water-settable material, wherein the water-settable material is flexible prior to being set, whereby, in use, after or when the inflatable chamber is inflated and the water-settable material is set, the first portion and second portion define a storage chamber for a liquid or other bulk material, and whereby after or when the water-settable material is set, the storage container and the walls are self-supporting.

2. An inflatable storage container according to claim 1 further comprising a third portion defining a lid, that is optionally removable, that seals the top of the perimeter wall.

3. An inflatable storage container according to claim 1 in which the second portion includes an inner layer of water impermeable material that isolates the cloth from the interior of the inflatable chamber.

4. An inflatable storage container according to claim 1 in which the base and optionally a lid that closes the top of the perimeter wall comprise at least one layer of cloth that has been impregnated with a water settable material.

5. An inflatable storage container according to claim 1 which further comprises a reinforcement structure that acts under tension when the container is filled with liquid.

6. An inflatable storage container according to claim 5 in which the reinforcement structure comprises one or more loops which extend continuously around the perimeter wall, and, optionally or preferably; wherein which the loop comprises a cable such as a stainless steel cable; and/or wherein which the reinforcement structure comprises panels of additional material that are fixed to the perimeter wall.

7. An inflatable storage container according to claim 5 in which the reinforcement structure is flexible allowing it to be folded into various shapes when the container has yet to be deployed.

8. An inflatable storage container according to claim 5 in which the reinforcement structure is located entirely within the inside of the inflatable chamber.

9. An inflatable storage container according to claim 1 in which the perimeter wall of the inflated container is circular when viewed in plan, and the reinforcement structure defines one or more substantially horizontal circular hoops that extend around the perimeter wall.

10. An inflatable storage container according to claim 1 that further comprises a support structure comprising a plurality of elongate substantially rigid rods that are oriented substantially vertically to help support the inflated structure against vertical loads.

11. An inflatable storage container according to claim 10 in which the rods comprise fibre glass poles; and/or wherein which one or more of the rods extend up from the base, along the inside of perimeter wall, across the top, and back down the inside of an opposing section of the perimeter wall to form an inverted u shape or rotated c shape.

12. An inflatable storage container according to claim 1 in which the water-settable material comprises a water settable mixture sandwiched between at least two layers of cloth with at least one layer optionally being a felt material.

13. An inflatable storage container according to claim 1 in which the water settable material is cement based, most preferably a quick setting cement and/or wherein the water settable material comprises CC Hydro™ (CCH5™) from Concrete Canvas.

14. An inflatable storage container according to claim 1 in which the portions of the deployable storage container when in a pre-deployment state are folded to fit within a footprint that is no larger in area than the base, and preferably a smaller area than that.

15. An inflatable storage container according to claim 1 in which the inside of the chamber is lined with a material suitable for safe containment of potable water; and/or having a capacity of at least 10000 litres.

16. An inflatable storage container according to claim 1 comprising a gas inlet valve which enables the inflatable chamber to be inflated using air or any other suitable gas.

17. An inflatable storage container according to claim 1 and an inflation system suitable for inflating the container to form its final deployed shape prior to the water-settable material having set.

* * * * *